US006508752B1

(12) United States Patent
Hällgren et al.

(10) Patent No.: US 6,508,752 B1
(45) Date of Patent: Jan. 21, 2003

(54) CENTRIFUGAL SEPARATOR HAVING END WALLS AND A CENTRAL SHAFT TO RESIST AXIALLY DIRECTED FORCES

(75) Inventors: Ingvar Hällgren, Tumba (SE); Hans Martin, Skärholmen (SE); Berndt Nyström, Bandhagen (SE)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 09/402,284

(22) PCT Filed: Mar. 26, 1998

(86) PCT No.: PCT/SE98/00548

§ 371 (c)(1),
(2), (4) Date: Dec. 29, 1999

(87) PCT Pub. No.: WO98/45045

PCT Pub. Date: Oct. 15, 1998

(30) Foreign Application Priority Data

Apr. 4, 1997 (SE) ..... 9701223

(51) Int. Cl.[7] ..... B04B 1/20

(52) U.S. Cl. ..... 494/51; 494/53; 494/70; 494/84

(58) Field of Search ..... 494/46, 50, 51, 494/52, 53, 54, 55, 57, 65, 66, 68, 69, 70, 74, 79, 81, 84; 210/512.1

(56) References Cited

U.S. PATENT DOCUMENTS

| | | | | |
|---|---|---|---|---|
| 820,568 | A | * | 5/1906 | Groves |
| 1,158,959 | A | * | 11/1915 | Beach |
| 1,277,676 | A | * | 9/1918 | Wright |
| 1,564,665 | A | * | 12/1925 | Gates |
| 2,321,918 | A | | 6/1943 | Jones |
| 2,622,794 | A | * | 12/1952 | Smith |
| 2,625,320 | A | * | 1/1953 | Lyons |
| 2,711,854 | A | * | 6/1955 | Kjellgren |
| 2,743,864 | A | * | 5/1956 | Lyons |
| 2,862,658 | A | | 12/1958 | Dahlgren |
| 3,275,230 | A | * | 9/1966 | Hiller |
| 3,685,721 | A | | 8/1972 | Kohama |
| 3,741,466 | A | * | 6/1973 | Weiland |
| 4,009,823 | A | * | 3/1977 | Nozdrovsky |
| 4,042,172 | A | * | 8/1977 | Nozdrovsky |
| 4,160,521 | A | * | 7/1979 | Lindgren |
| 4,245,777 | A | | 1/1981 | Lavanchy |
| 4,508,530 | A | | 4/1985 | Schlegel et al. |
| 4,698,053 | A | | 10/1987 | Stroucken |
| 5,182,020 | A | * | 1/1993 | Grimwood |
| 5,310,399 | A | * | 5/1994 | Suzuki |
| 5,314,399 | A | * | 5/1994 | Suzuki |
| 5,364,335 | A | * | 11/1994 | Franzen et al. |
| 6,030,332 | A | * | 2/2000 | Hensley |
| 6,142,924 | A | * | 11/2000 | Cornay |
| 6,217,502 | B1 | * | 4/2001 | Hallgren et al. |

FOREIGN PATENT DOCUMENTS

| | | | |
|---|---|---|---|
| CH | 301080 | * | 11/1954 |
| FR | 1449064 | * | 7/1966 |
| FR | 1455032 | * | 10/1966 |
| GB | 999953 | * | 7/1965 |
| JP | 2-40248 | * | 2/1990 |
| SE | 9603097-8 | | 2/1998 |

* cited by examiner

*Primary Examiner*—Charles E. Cooley
(74) *Attorney, Agent, or Firm*—Fish & Richardson P.C.

(57) ABSTRACT

In a centrifugal separator for separating solid particles from a liquid, a centrifugal rotor (2) has two axially separated end walls (13, 14) and a surrounding wall (17) arranged therebetween. The end walls (13, 14) and the surrounding wall (17) surround a separation chamber (20) in which there are arranged separation discs (21) and one or more conveyor screws (29, 62) for axial transportation of separated solid particles. According to the invention the end walls are connected with each other through a central member (15), which is dimensioned in a way such that during the rotor operation it will take up a substantial part, preferably at least 80%, of the forces acting axially on the end walls (13, 14) as a consequence of centrifugally generated pressure of liquid present in the separation chamber (20).

7 Claims, 9 Drawing Sheets

CENTRIFUGAL SEPARATOR HAVING END WALLS AND A CENTRAL SHAFT TO RESIST AXIALLY DIRECTED FORCES

FIELD OF THE INVENTION

The present invention relates to a centrifugal separator for freeing a liquid from solid particles suspended therein and having a density larger than that of the liquid.

BACKGROUND OF THE INVENTION

Several different types of centrifugal separators for this purpose are known, being arranged during operation to discharge continuously or intermittently sludge, which contains separated solid particles. Each one of the various types is intended for treatment of liquid containing particles in a certain amount and/or of a certain kind.

Thus, there are so called decanter centrifuges for treatment of liquids containing a relatively large amount of particles. An ordinary decanter centrifuge has a normally elongated rotor, in the separation chamber of which only one single conveyor screw is arranged to rotate around the same rotational axis as the rotor but with a different speed than that. Separated particles in this way may be transported by the conveyor screw axially within the rotor up to normally constantly open so-called sludge outlets. A decanter centrifuge of this kind is shown for instance in U.S. Pat. No. 4,245,777.

A decanter centrifuge of a somewhat different kind is shown in U.S. Pat. No. 3,685,721. This decanter centrifuge has several conveyor screws arranged in the centrifuge rotor separation chamber evenly distributed around the rotational axis of the centrifugal rotor. Each of the conveyor screws is arranged to transport separated particles to and out through a sludge outlet at one end of the separation chamber.

A centrifugal separator reminding of an ordinary decanter centrifuge, i.e. having only one conveyor screw, but having an intermittently openable so called sludge outlet, is shown in U.S. Pat. No. 4,508,530. In this centrifugal separator, which is intended for freeing a liquid from both solid particles heavier than the liquid and from liquid drops dispersed/emulgated in the liquid and being lighter than the carrying liquid, there is used for the separation also a set of conical separation discs which are arranged in the separation chamber radially inside the conveyor screw.

A decanter centrifuge as a rule has a large rotor volume and, thereby, a relatively large capacity, i.e. a large flow of a liquid containing a large amount of solid particles can be treated. The elongated rotor is normally journalled at both its ends and is adapted to rotate about a horizontal rotational axis. This means that a decanter centrifuge requires a relatively large floor area for its rotor, its driving means and its gear box, the last mentioned being needed for operation of the sludge transportation device within the rotor. Decanter centrifuges having centrifugal rotors rotatable around vertical axes are also known, however, for instance through U.S. Pat. No. 2,862,658. The rotor of such a decanter centrifuge is journalled either at its lower end or at its upper end.

Centrifugal separators of the kinds described so far are, as mentioned before, intended above all for treatment of large flows of liquid containing relatively large amounts of particles. For this purpose they have been given a construction which does not make large rotational speeds of the centrifugal rotor possible and which, therefore, are not suitable when there are requirements of substantial cleanliness of the separated liquid.

For such requirements of substantial cleanliness of the separated liquid there are other types of centrifugal separators. These are so formed, however, that they are not suitable for treating large flows of liquid having a large content of solid particles. Thus, there are so called nozzle separators of a kind shown for instance in U.S. Pat. No. 2,321,918. The rotor of a centrifugal separator of this type normally has a set of conical separation discs in its separation chamber and a rotor body the radial extension of which is in the same order as its axial extension. The reason for this form of the rotor body is that particles being separated from a liquid in the separation chamber should be able to move by themselves, i.e. slide on the surrounding wall of the separation chamber, without assistance from separate sludge transportation means, to sludge outlet nozzles situated at the surrounding wall of the rotor and being open or intermittently openable. The surrounding wall of the separation chamber in this case is constituted mainly by two conical rotor end walls, which are united with each other along their surrounding edges. A rotor having a design like this is expensive to produce and gets by necessity a rather large diameter without for this reason being usable for treatment of large amounts of sludge.

There are also centrifugal separators the centrifugal rotors of which in addition to conical separation discs in the separation chamber have equipment for intermittent discharge of particles from the separation chamber through separate openings or a slot extending all around the rotational axis of the rotor. The rotors for centrifugal separators of this kind are even more expensive to produce than rotors for nozzle separators and are even less suitable for freeing of liquids from large amounts of particles suspended therein. One example of a centrifugal separator of the last mentioned type is shown in U.S. Pat. No. 4,698,053.

SUMMARY OF THE INVENTION

The purpose of the present invention is to accomplish a construction for a centrifugal separator, which makes possible a design for the centrifugal rotor such that it gets a large separation efficiency, can be subjected to a large rotational speed, i.e. a large centrifugal force, and can be used for treatment of liquids containing small as well as large amounts of particles. The construction also should be such that the centrifugal rotor becomes relatively cheap to produce.

According to the invention this object can be achieved by means of a centrifugal separator which has a rotor having a center axis around which it is rotatable, the rotor comprising two axially spaced end walls and a surrounding wall arranged axially between the end walls and surrounding together therewith a separation chamber, the axial extension of which is substantially larger than the radial extension thereof, the end walls being adapted to be subjected to axially directed forces as a consequence of centrifugally generated pressure of liquid in the separation chamber, which forces strive to push the end walls away from each other; inlet means forming an inlet for introducing said liquid and particles suspended therein into the separation chamber; separation discs arranged in the separation chamber for creating small separation distances for the particles to be separated from the liquid; first outlet means forming a first outlet for discharging liquid having been freed from particles; second outlet means forming a second outlet for discharging particles having been separated from the liquid; transportation means comprising at least one transportation member which is situated within the separation chamber and is rotatable relative to the rotor, while this is rotating, for the transportation of separated particles axially in the separation chamber; transmission means for driving of the transportation means; and a central member extending between said end walls through the separation chamber and being dimensioned and connected with the two end walls in a way such that it will take up a substantial part of the forces acting axially on the end walls during the operation of the rotor.

In a centrifugal separator of this kind the centrifugal rotor may be given an axial extension which is large in relation to the diameter of the rotor, since separate transportation means is arranged for axial transportation of solid particles separated from the liquid. As a consequence of the force transferring connection between the rotor end walls and the central member the surrounding wall of the rotor need not transfer large axial forces caused by the pressure against the rotor end walls of the liquid present in the separation chamber during the operation of the centrifugal separator. Hereby, the connection between the surrounding wall and the end walls may be made relatively simple, since not even these connections need to transfer large axial forces. The rotor then may be produced relatively cheaply and still be designed for very large rotational speeds. This means that the invention makes it possible to produce a centrifugal separator able to separate large amounts of particles from a liquid and to separate the particles from the liquid rapidly and efficiently in that the separation discs, which may fill a large part of the elongated separation chamber, may be used in the best possible way.

Since the surrounding wall of the rotor need not be subjected to large axial forces in spite of a large rotational speed it can be produced from a thin material reinforced in the circumferential direction of the rotor by fibers of one kind or another, for instance carbon or glass fibers. The surrounding wall in this way may be given a large strength despite a small weight, which strongly contributes to making the rotor rotatable at a large speed.

For obtainment of the desired advantages of the invention it would be necessary that the central member, taking up axial forces, is arranged to take up at least half of said forces acting axially on the end walls during the rotor operation. However, preferably, the central member is adapted to take up substantially all such axial forces, i.e. more than 80% thereof.

Within the scope of the invention the rotor outlet for separated particles may be constantly open and provided with suitably dimensioned nozzles.

In a preferred embodiment of the invention, however, the rotor comprises outlet means adapted for intermittent opening of the rotor outlet for separated particles. Hereby, the outlet may be made large enough for safely avoiding clogging thereof, which is particularly important if some of the particles are substantially larger than others.

The above said transmission means for operating the transportation means in the rotor preferably is controllable in a way such that the axial transportation of separated particles in the rotor can be adapted to the actual content of particles in the treated liquid.

Even if the invention can be used also in combination with a sludge conveyor of the kind to be seen in an ordinary decanter centrifuge, e.g. according to U.S. Pat. No. 4,245,777, said transportation means preferably includes at least two conveyor screws journalled in the rotor and adapted to rotate around respective axes extending substantially in the axial direction of the rotor close to the surrounding wall of the rotor. In this case the separation chamber preferably has separate outlets for separated particles, each one of the conveyor screws being arranged to transport separated particles to one of the separate outlets.

If the centrifugal separator according to the invention has only one sludge conveyor in the rotor, extending helically around the center axis of the rotor along the surrounding wall thereof, it is desirable that the above mentioned central member takes up substantially all the axial forces caused by liquid in the separation chamber during operation of the rotor. Otherwise it is difficult to use the advantage of the invention that the surrounding wall of the rotor could be produced by a thin and light material reinforced by fibers extending substantially only in the circumferential direction of the rotor. However, if the centrifugal separator is of a kind having several sludge conveyor screws distributed around the center axis of the rotor the preconditions are somewhat different. In cases like that a number of bolts may extend between the two end walls of the rotor in the areas between the sludge conveyor screws radially inside the surrounding wall. In these areas there are normally arranged so called filler pieces, and said bolts preferably extend through these filler pieces.

Bolts of this kind may, if desired, be adapted to take up up to 50%, however preferably not more than 60%, of the forces acting axially against the end walls and caused by the pressure of the liquid in the separation chamber during operation of the rotor.

Alternatively, of course, the surrounding wall of the rotor, if desired, may be arranged to take up all or part of the axial forces which are not taken up by the above mentioned central member.

The separation discs in the separation chamber may be of any suitable kind. Preferably they are formed like truncated cones and stacked upon each other coaxially with the rotor. Alternatively, they may be formed such that they extend substantially axially through the whole or a part of the separation chamber and each of them extends arcuately from said central member towards the surrounding wall of the rotor, seen in a section through the rotor across the center axis thereof. In DE 48615 there is shown and described some different kinds of separation discs which may be used in a centrifugal separator according to the invention.

BRIEF DESCRIPTION OF THE DRAWINGS

The invention is described in the following with reference to the accompanying drawing, in which.

DETAILED DESCRIPTION

Figure 1:
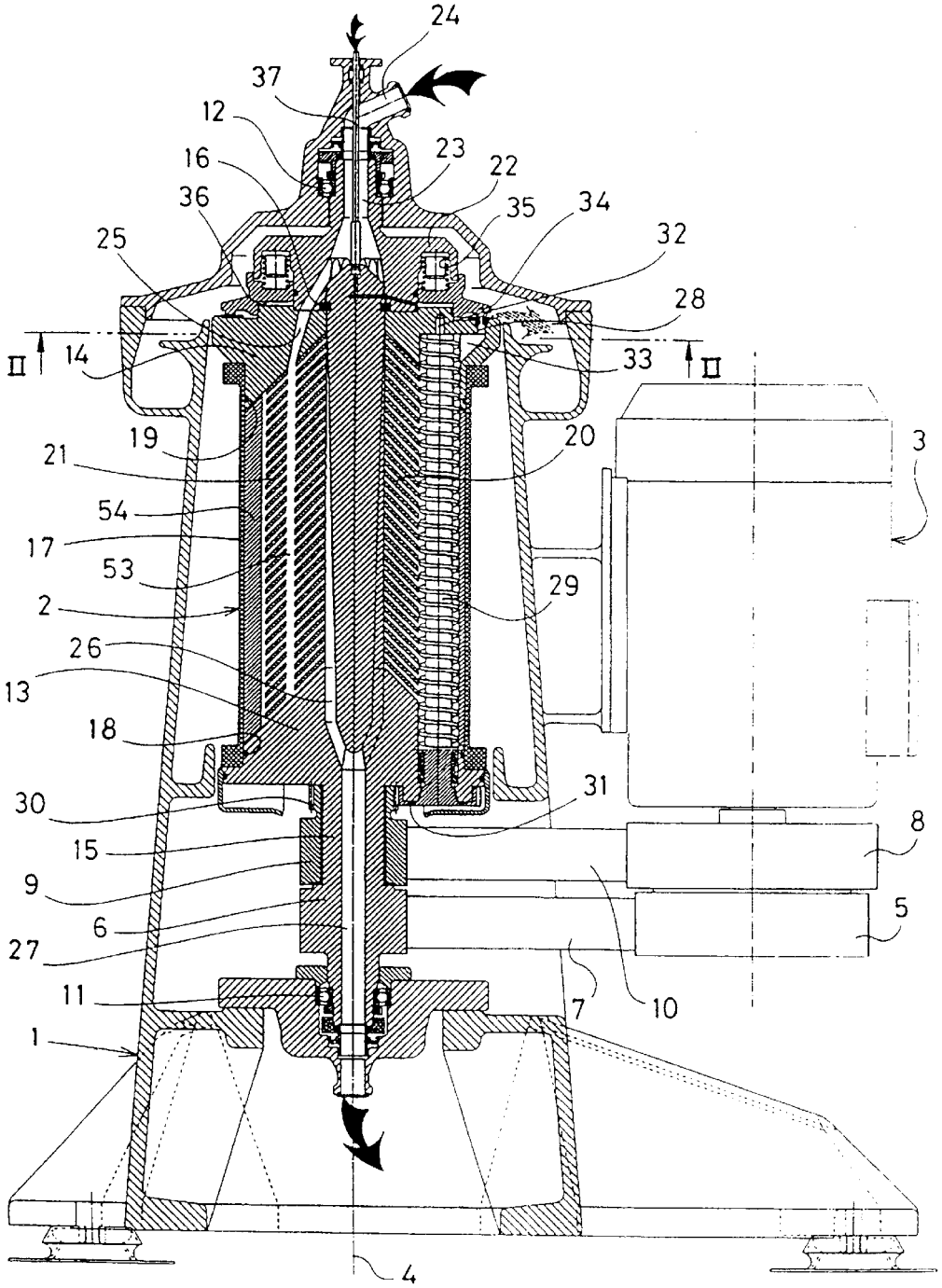
FIG. 1 shows in a longitudinal section a centrifugal separator according to a preferred embodiment of the invention.

FIG. 1 shows a centrifugal separator for freeing a liquid from solid particles suspended therein and having a density larger than that of the liquid. The centrifugal separator comprises a frame 1, a rotor 2 that is rotatably supported by and within the frame 1 and a motor 3 that is also supported by the frame but on its outside and that is adapted for rotation of the rotor 2 about a vertical rotational axis 4 coinciding with the center axis of the rotor. For this purpose the motor 3 supports on its drive shaft a belt pulley 5 and the rotor supports at its lower part a belt pulley 6. A drive belt 7 surrounds both the belt pulleys 5 and 6.

The motor 3 supports on its drive shaft a further belt pulley 8, which together with an annular transmission member 9 arranged coaxially with the rotor 2 and rotatable relative thereto is surrounded by a further drive belt 10.

The rotor 2, which is rotatably suspended in the frame by means of a lower bearing 11 and an upper bearing 12, comprises a lower end wall 13 and an upper end wall 14. The lower end wall 13 is formed in one piece with a shaft 15 that extends all the way from the area of the lower bearing 11 past the lower end wall 13 up to the upper end wall 14 and through a central opening therein. By means of a locking member 16 the upper end wall 14 is fixed relative to the shaft 15 at least in a way such that it cannot move in a direction away from the lower end wall 13. By means not shown the end wall 14 is also fixed relative to the shaft 15 in its circumferential direction. The rotor further comprises a circular-cylindrical surrounding wall 17, which extends axially between the end walls 13 and 14, coaxially surrounding the shaft 15 spaced therefrom. The surrounding wall 17 shall not transfer any substantial axial force and, therefore, is not firmly connected with the end walls 13 and 14. Instead, the surrounding wall 17 abuts at its ends through annular gaskets 18 and 19 radially against the respective end walls 13 and 14. However, the surrounding wall 17 is formed such that it can take up very large forces in its circumferential direction and, therefore, is reinforced by carbon or glass fibers extending substantially in said circumferential direction.

The end walls 13, 14 and the surrounding wall 17 surrounds a separation chamber 20 within the rotor. The separation chamber 20 surrounds the shaft 15 and has an axial extension substantially larger than its radial extension.

Within the separation chamber 20 coaxially with the rotor a stack of frusto-conical separation discs 21 is arranged between the end walls 13, 14. By means of spacing members the separation discs are maintained at some axial distance from each other.

The upper end wall 14 on its outside is connected with an inlet member 22 forming a central, vertical inlet channel 23. This inlet channel 23 communicates at its upper end with an inlet 24 for liquid to be treated within the rotor, and it branches off at its lower end in several branch channels 25. The branch channels 25 which are formed partly in the inlet member 22 and partly in the upper end wall 14 open into the upper part of the separation chamber 20 radially about half-way between the central rotor shaft 15 and the surrounding wall 17.

The lower end wall 13 has a number of branch channels 26 intended for liquid having been treated in the rotor. The branch channels 26 start from the lower part of the separation chamber 20 and extend to a common outlet channel 27 which in its turn extends further centrally in the rotor shaft 15 to and out through the lower end thereof.

For solid particles having been separated from said liquid in the separation chamber 20 the rotor has several outlet channels 28 extending from the uppermost part of the separation chamber axially through the upper end wall 14 at the radially outermost portion thereof. For transportation of particles separated in the separation chamber 20 to the outlet channels 28 the rotor comprises a conveyor screw device including several conveyor screws 29. These extend axially through the separation chamber 20 close to the surrounding wall 17 and are evenly distributed around the rotor shaft 15. Each conveyor screw 29 is journalled at its ends in the respective end walls 13, 14 and is rotatable around its center axis relative to the rotor walls during the rotation of the rotor around its rotational axis 4.

For the rotation of the conveyor screws 29 relative to the rotor the rotor shaft 15 supports immediately below the lower end wall 13 the above said annular member 9. This member 9 surrounds the rotor shaft 15 and is adapted by means of the motor 3 through the driving belt 10 to be rotated around the rotational axis 4 of the rotor at a speed different than that of the rotor. The annular member 9 has on its outside axially above the driving belt 10 a gear ring 30 engaging several bearing members 31 evenly distributed around the rotor shaft 15. Each bearing member 31 is connected with a conveyor screw 29 and forms part of a slide bearing through which the conveyor screw 29 is journalled in the lower end wall 13. The bearing member 31 and its co-operation with the gear ring 30, the end wall 13 and the conveyor screw 29 is described more in detail below with reference to FIG. 3.

Figure 2:
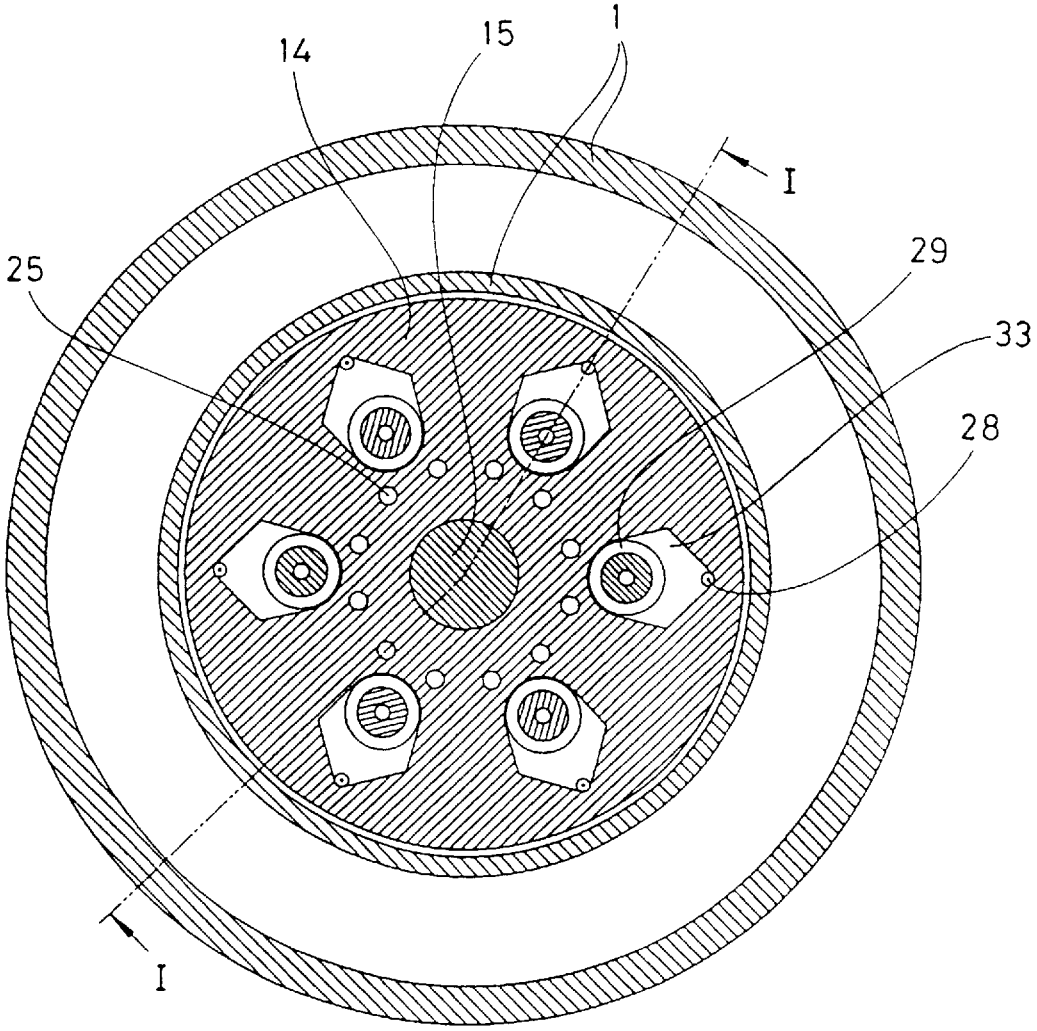
FIG. 2 shows a section along the line II—II in FIG. 1.

At its upper end each conveyor screw 29 is journalled in the upper end wall 14 by means of a pin 32. Radially outside the uppermost end portion of each conveyor screw 29 and axially in the area of the uppermost separation disc 21 there is delimited in the separation chamber 20 by the upper end wall 14 a space or a pocket 33 which extends radially outwardly from said end portion of the conveyor screw to a level radially outside the inside of the surrounding wall 17. At the radially outermost part of each such pocket one of the afore-mentioned outlet channels 28 is situated. FIG. 2 shows a section through the upper end wall 14, taken along the line II—II in FIG. 1. Between adjacent pockets 33 parts of the end wall 14 form filler pieces which prevent communication between the sludge pockets in the circumferential direction of the rotor.

For closing and intermittent uncovering of the outlet channels 28 the rotor is provided with an axially movable slide 34. By means of springs 35 arranged between the inlet member 22 and the slide 34 the slide 34 is kept pressed against the outside of the upper end wall 14, axial protuberances of the slide 34 abutting sealingly against the end wall around the openings of the respective outlet channels 28.

Between the slide 34 and the end wall 14 there is delimited radially inside the outlet channels 28 a so called opening chamber 36, which via channels through the inlet member 22 and the rotor shaft 15 communicates with the interior of a narrow tube 37 extending axially upwardly through and out of the inlet member 22 to an upper pressure source of air (not shown). Through supply of pressurized air to said opening chamber 36 the slide 34 during rotation of the rotor may be caused to move axially upwardly against the action of springs 35, so that the outlet channels 28 are uncovered.

Figure 3:
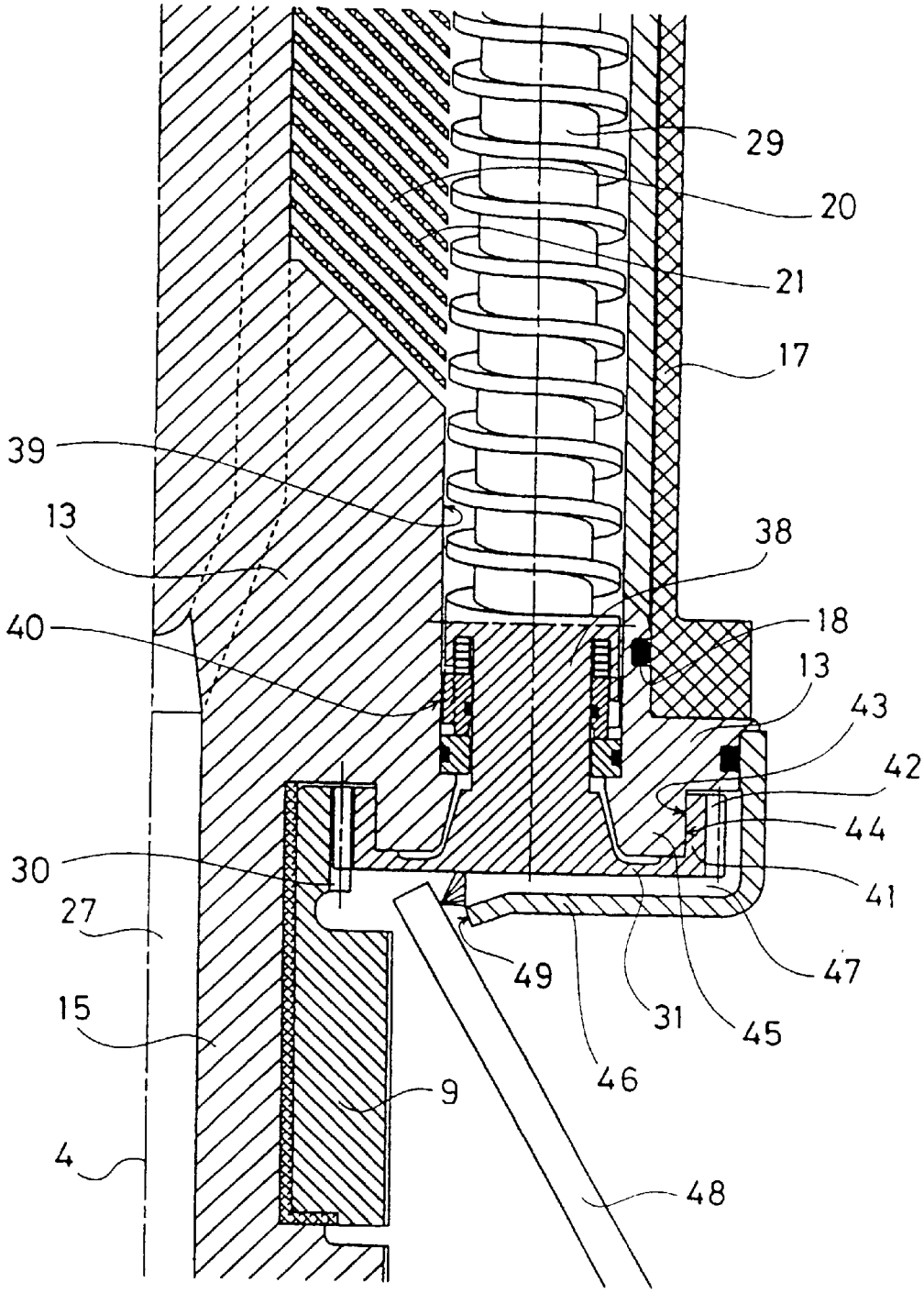
FIG. 3 shows an enlarged part of FIG. 1.

FIG. 3 shows in an enlarged scale part of FIG. 1. It can thus be seen from FIG. 3 that the bearing member 31 is supported by a transmission shaft in the form of a short tap 38 extending within a bore 39 in the end wall 13 and connected with the conveyor screw 29. The bearing member 31 with its tap 38 as well as the conveyor screw 29 may be made of plastic. A sealing device 40 is arranged in the bore 39 and is adapted to seal between the tap 38 and the end wall 13.

The bearing member 31 has a tubular surrounding part 41, which on its outside is provided with cogs 42 and on its inside has a slide bearing surface 43. The cogs 42 engage the gear ring 30 of the annular member 9, and the slide bearing surface 43 co-operates with a corresponding slide bearing surface 44 formed on an annular protuberance 45 on the outside of the end wall 13. The protuberance 45 which may have a surface layer of a ceramic material provided with said slide bearing surface 44 surrounds the opening of the bore 39 in the end wall 13, and the two co-operating slide bearing surfaces 43, 44 thus have a substantially larger circumference than the bore 39.

On the outside of the rotor end wall 13 there is mounted an annular further wall 46. This confines between itself and the outside of the end wall 13 an annular transmission chamber 47, which is closed radially outwardly but open radially inwardly towards the rotor shaft 15. The chamber 47 during operation of the rotor may be filled with liquid, e.g. water, through a supply pipe 48 and is intended always to be filled during operation of the rotor. A radially inner edge 49 of the further wall 46 may serve as an overflow outlet for liquid being supplied to the chamber 47.

As can be seen from FIG. 3, a substantial part of the bearing member 31 will be present during operation of the rotor in liquid present in the chamber 47. This liquid has two purposes; firstly, it shall operate as a lubricator between the slide bearing surfaces 43 and 44, when the conveyor screw 29 rotates relative to the rotor, and secondly it shall create an hydraulic force acting on the bearing member 31 in a direction towards the rotational axis 4 of the rotor. The hydraulic force counteracts the centrifugal force to which the bearing member is subjected during its rotation around the rotational axis 4 of the rotor and, thereby, acts unloading on the slide bearing formed by the bearing member 31 and the protuberance 45 on the rotor end wall 13.

Figure 4:
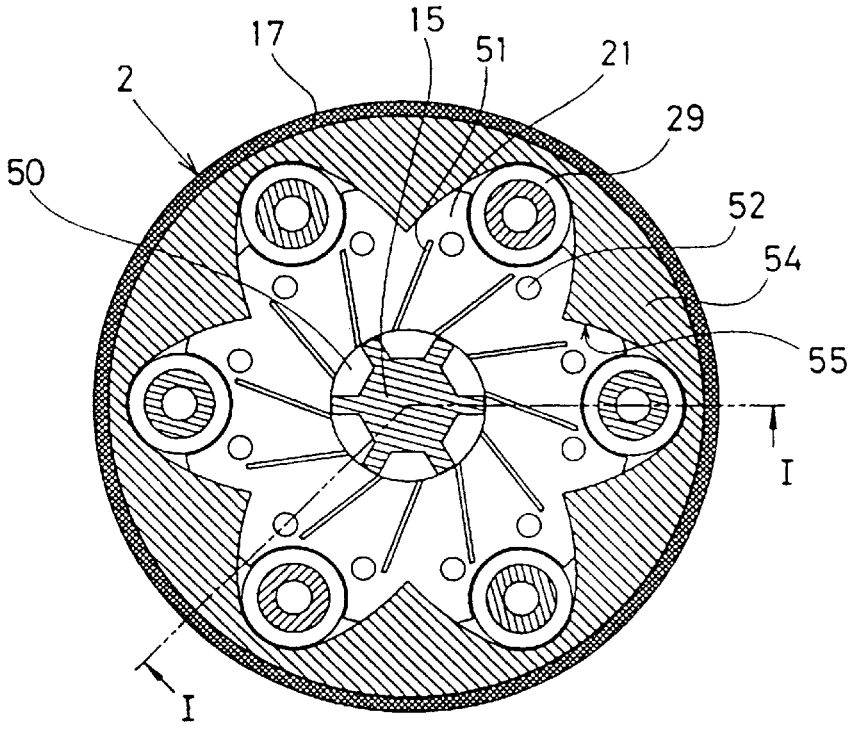
FIG. 4 shows a cross-section through the centrifugal rotor shown in FIG. 1, taken between two adjacent separation discs.
Figure 5:
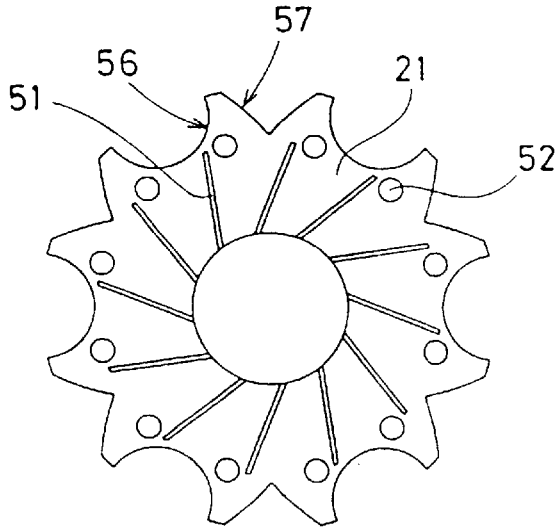
FIG. 5 shows a separation disc of the kind shown in FIG. 4.

FIG. 4 shows a cross section through the rotor 2 in FIG. 1. The section is taken between two adjacent conical separation discs 21. FIG. 5 shows a single separation disc 21 of the kind also shown in FIG. 4.

From FIG. 4 it can be seen further that the center shaft 15 of the rotor has axial grooves 50 forming axial flow paths radially inside the separation discs 21 for liquid which has been freed from solid particles in the separation chamber 20. The separation discs 21 are supported radially in all directions by the shaft 15. FIG. 4 also shows that the separation discs 21 are provided with several conventional spacing members 51 which are evenly distributed around the shaft 15 and keep the separation discs at a desired distance from each other.

The separation discs 21 have several through-holes 52, each being placed between two adjacent spacing members 51, the holes being axially aligned with corresponding holes in the other separation discs 21. The holes 52 form axial so called distribution channels 53 (FIG. 1) through the stack of separation discs axially aligned with the openings of the previously mentioned branch channels 25 in the upper rotor end wall 14.

A filler piece 54 extends inside the surrounding wall 17 around the stack of separation discs 21 and the conveyor screws 29. This filler piece has recesses for the conveyor screws 29 and extends in the areas between the conveyor screws radially inwardly forming axially extending ridges which have contact with the separation discs 21. The separation discs which are relatively thin and may be made of plastic receive during operation of the rotor, therefore, radial support from the said ridges of the filler piece 54. Between the conveyor screws the filler piece is so formed that solid particles which during operation of the rotor are separated from the liquid and move radially outwardly between the separation discs will slide on the hills 55 of said ridges in a direction towards the conveyor screws and in between their threads.

FIG. 5 shows that each separation disc has both recesses 56 for the conveyor screws 29 and recesses 57 for the filler piece 54.

Figure 6:
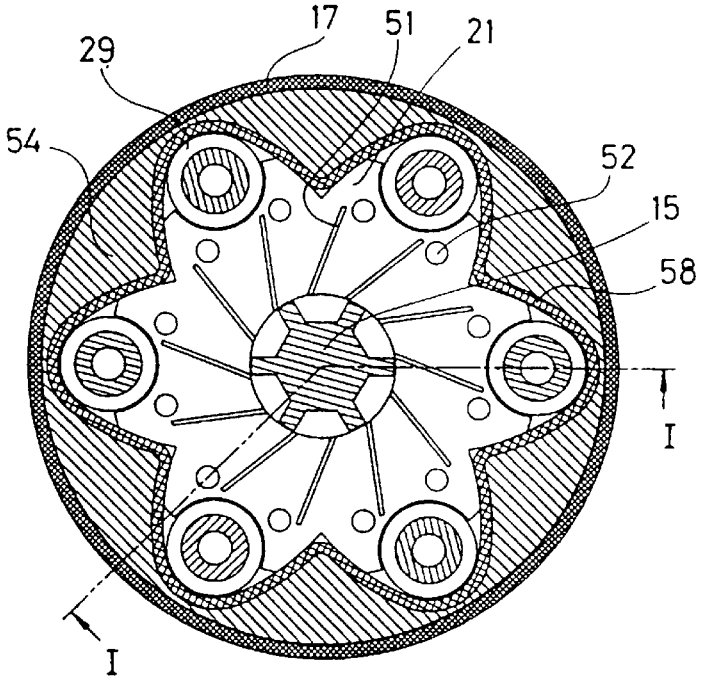
FIG. 6 shows a cross-section, similar to that in FIG. 4, of a somewhat modified embodiment of the invention.

The filler piece 54 may be formed in one piece, suitably from plastic or some other relatively light material. Alternatively, it may be composed of several annular elements having the cross-sectional form shown by the filler piece 54 in FIG. 4, or from several straight axially extending elements, which are evenly distributed around the rotational axis of the rotor. For covering of the interspaces which may remain between annular or straight elements of this kind a lining 58 of plastic or other material, as shown in FIG. 6, may be arranged on the inside of the filler piece 54.

A further alternative for the forming of the filler piece 54 is that the conical separation discs are formed so that they form together said filler piece. This alternative is illustrated in the FIGS. 7–9.

Figure 7:
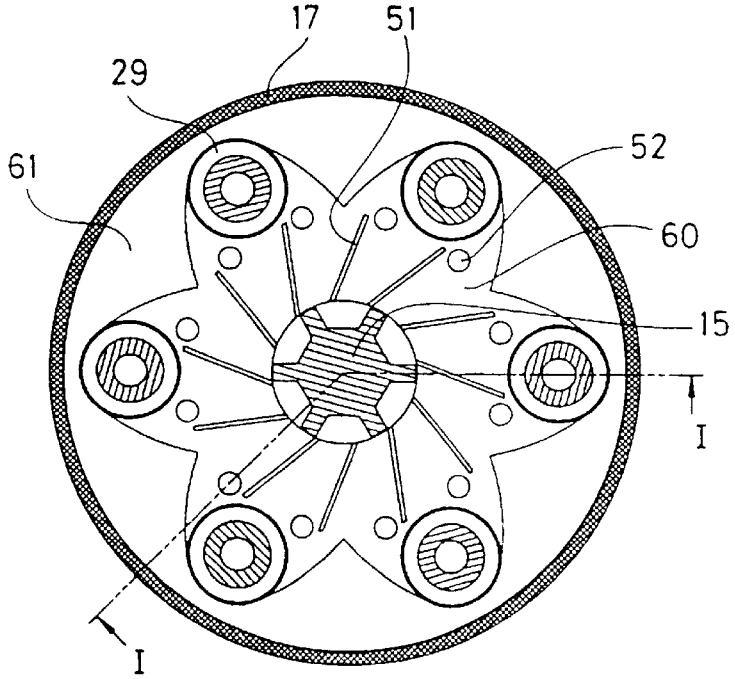
FIG. 7 shows a cross-section, similar to that in FIG. 4, of a further modified embodiment of the invention.
Figure 8:
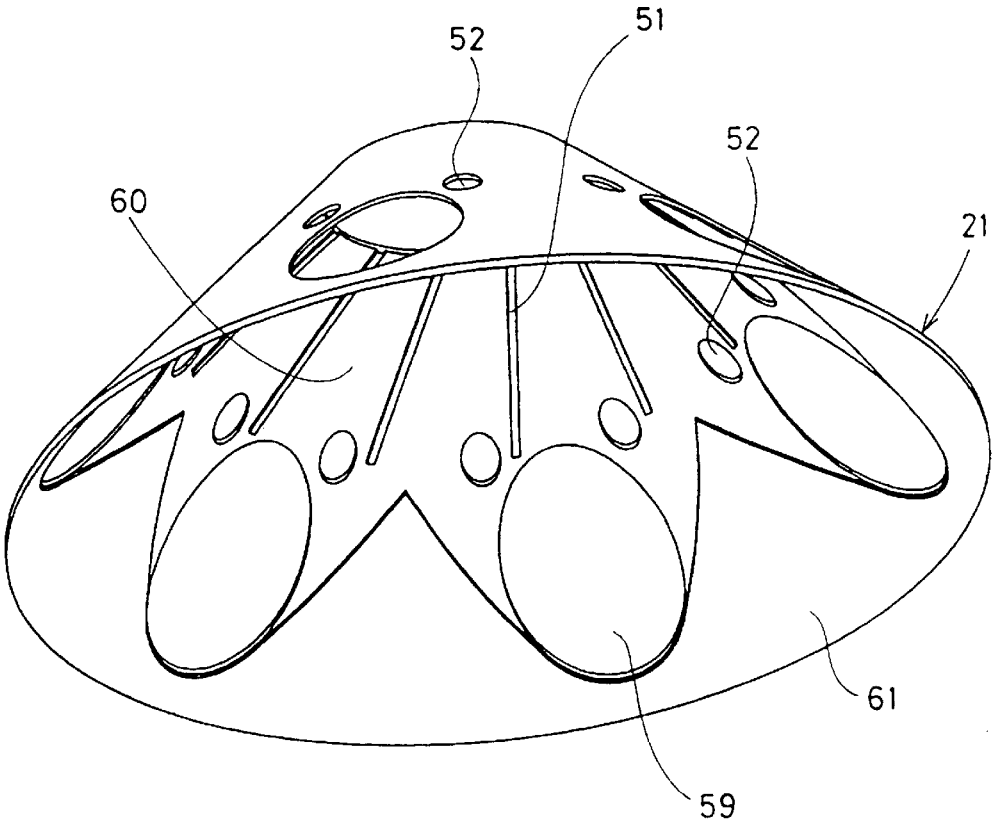
FIG. 8 shows a separation disc of the kind included in the modified embodiment of the invention according to FIG. 7.
Figure 9:
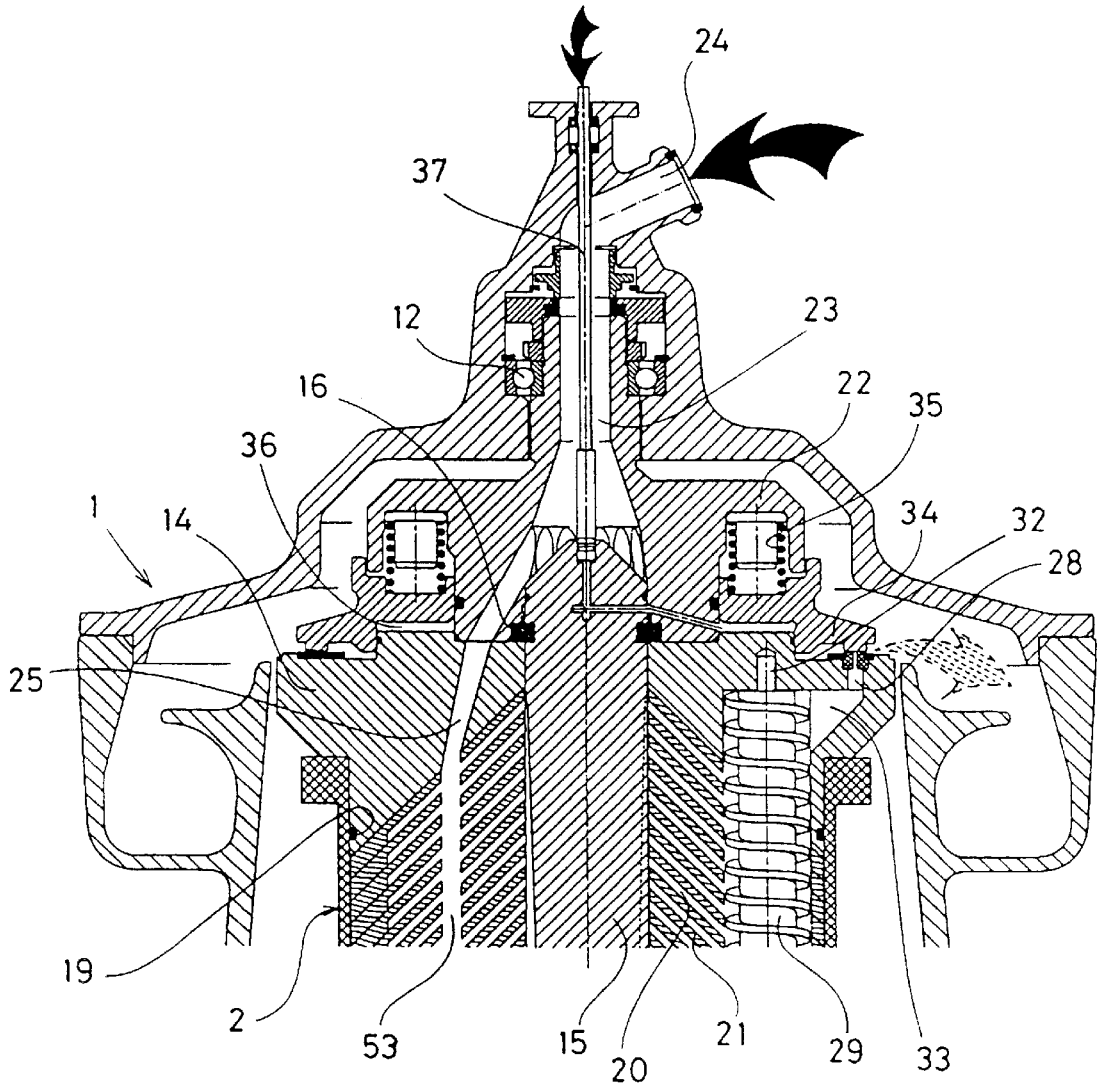
FIG. 9 shows in a longitudinal section part of a centrifugal separator having separation discs of the kind shown in the FIGS. 7 and 8.

As can be seen from the FIGS. 7 and 8 a separation disc 21 in this case has an entirely circular circumference and extends into contact with the surrounding wall 17 of the rotor around the whole of its circumference. The separation disc has through-holes 59 intended for the conveyor screws 29.

Like the separation disc shown in FIG. 5 the separation disc in FIG. 8 has spacing members 51 formed on its underside. In case these spacing members 51 are formed in one piece with the separation disc 21, this has a certain thickness in the areas of the spacing members 51 and a smaller thickness in the areas 60 situated between the spacing members 51. In the areas 60 there is thus created, when two separation discs abut against each other in a stack, a space in which liquid may flow between the separation discs.

The thickness that the separation disc in FIG. 8 has at the spacing members 51 it also has in a continuous area 61 extending along the whole of the circumference of the separation disc radially outside the holes 59 and between adjacent such holes 59 a distance radially inwardly towards the rotor shaft 15.

In a stack of separation discs formed as shown in FIG. 8 the separation discs will abut against each other in the areas 61 (see FIG. 9) and they will thus form in these areas a filler piece similar to the filler piece 54 in FIG 4.

Common to the different embodiments of the filler piece 54 is that this is created around the whole of the rotor radially inside the circular-cylindrical surrounding wall 17, which is formed to take up large forces in the circumferential direction of the rotor. It is thus important that the surrounding wall of the rotor has a circular-cylindrical strong portion that surrounds the separation chamber 20 and the sludge conveyor screws 29.

The centrifugal separator described above with reference to the FIGS. 1–9 operates briefly in the following manner.

After the rotor 2 has been caused to rotate around its rotational axis 4 and the conveyor screws 29 simultaneously have been caused to rotate around their respective rotational axes relative to the rotor 2, a suspension of liquid and particles dispersed therein and having a density larger than that of the liquid is supplied through the inlet 24. The suspension is conducted through the channels 23 and 25 to the distribution channels 53 in the stack of separation discs 21. From respective holes 52 in the separation discs 21 the suspension flows out into the spaces between the separation discs 21 and is conducted between adjacent spacing members 51 to the axial channels 50 at the rotor shaft 15 (see FIG. 4).

On the way between the holes 52 and the channels 50 said particles are separated from the liquid and they slide along the underside of the separation discs back radially outwardly towards the conveyor screws 29. The inclined surfaces 55 on the filler piece 54 (see FIG. 4) makes the particles collecting exactly in the areas of the conveyor screws 29.

In the areas of the conveyor screws 29 the particles form a sludge which by the conveyor screws is transported axially within the separation chamber 20 towards the upper rotor end wall 14.

In the end wall 14 each conveyor screw 29 extends through a short cylindrical bore which opens into a pocket 33 (see FIGS. 1 and 2). The sludge formed in the separation chamber 20 is thus transported through these bores and out into the pockets 33. From here the sludge is discharged intermittently through the outlet channels 28 in that these are uncovered by means of the slide 34 at desired time intervals. The slide can be actuated by supply of pressurized air to the opening chamber 36. When sludge is supplied through said bore to a pocket 33, displaced liquid is conducted away from the pocket 33 to the separation chamber 20 in the part of the bore that is situated closest to the center axis 4 of the rotor, where a narrow slot is formed between the threads of the conveyor screw 29 and the wall of the bore. The liquid having been freed from particles is conducted out of the rotor below the lower end wall 13 through the channels 26 and 27.

The slide 34 alternatively may be adapted automatically to uncover the outlet channels 28, when a predetermined resistance against turning of the conveyor screws 29 is obtained, indicating that a certain amount of sludge has been collected in the separation chamber.

Since the inlet for suspension is arranged at one end and the outlet for liquid at the opposite end of the separation chamber 20, and the outlet for sludge is arranged at the inlet end of the separation chamber, good prerequisites are obtained for liquid leaving the separation chamber to be substantially free from particles.

In the embodiments of the invention having been described above and shown in the drawings the conical separation discs are arranged in a way such that they face with their apex ends upwardly. If desired, they may instead be arranged with their apex ends facing downwardly towards the outlet for cleaned liquid. Then, the end walls 13 and 14 are suitably formed in a corresponding way, the lower end wall 13 then forming an upwardly open funnel which with its apex portion forms the central outlet for cleaned liquid. If the lower end wall 13 is formed in this way a complete emptying of the separation chamber 20 is facilitated after a finished separating operation.

During the separating operation axially directed pressures against both the end walls 13 and 14 of the rotor come up as a consequence of the centrifugal force to which the liquid and the particles in the separation chamber are subjected. The whole of this force is taken up by the rotor shaft 15 which is fixed relative to both of the end walls 13 and 14.

Figure 10:
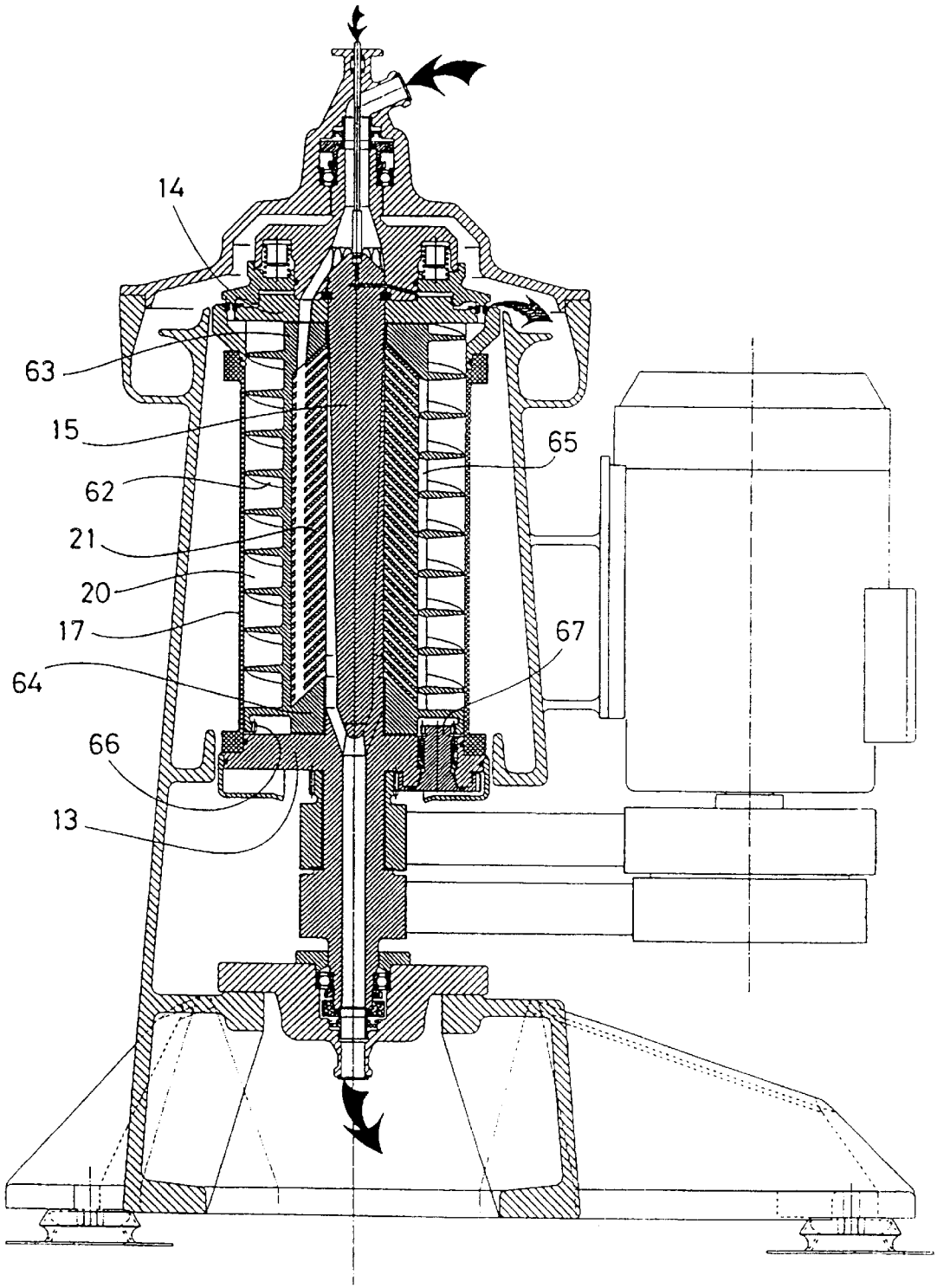
FIG. 10 shows in a longitudinal section a centrifugal separator according to a further embodiment of the invention.
Figure 11:
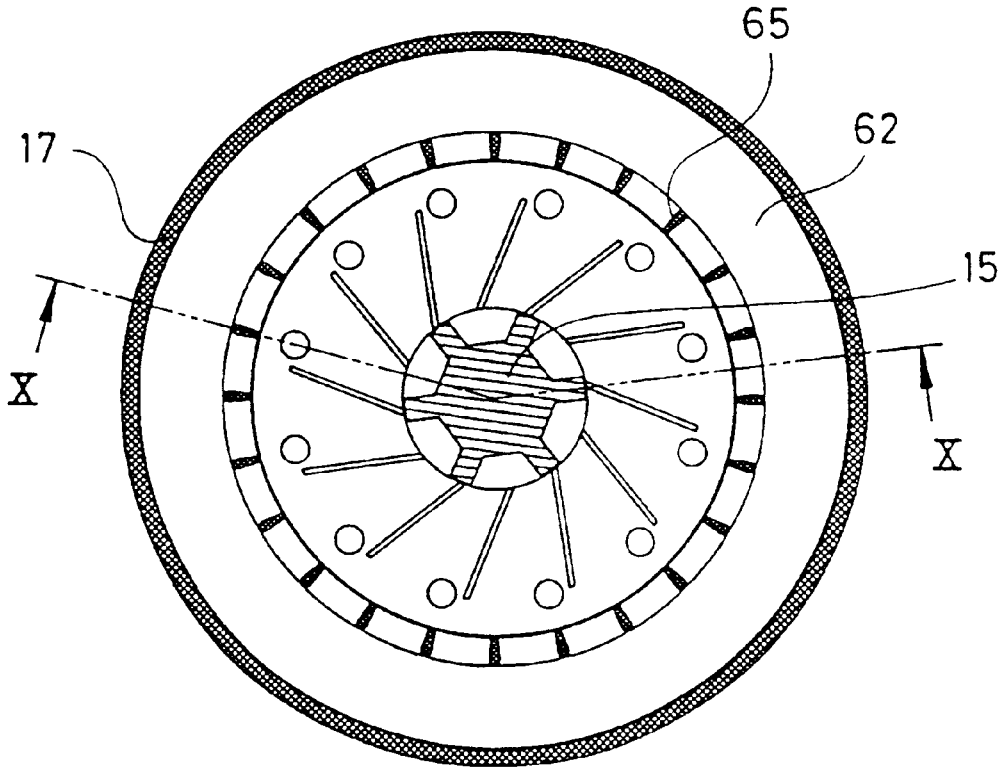
FIG. 11 shows a cross-section through the centrifugal rotor shown in FIG. 10.

The FIGS. 10 and 11 illustrate an alternative embodiment of a centrifugal separator according to the invention. In the following only the most important differences between this embodiment and the previously described embodiments will be mentioned. The same reference numerals have been used in the FIGS. 10 and 11 as in the other figures for details which substantially correspond to each other.

The centrifugal separator in the FIGS. 10 and 11 has only one single conveyor screw 62 and this extends helically around the rotor shaft 15 through the separation chamber 20.

At its ends the conveyor screw 62 is journalled by means of bearing members 63 and 64 directly on the rotor shaft 15. The bearing members 63 and 64 are firmly connected with each other by means of axial rib-formed elements 65 extending axially through the separation chamber 20 at the outer edges of the separation discs 21. The elements 65 during the rotation of the rotor may give radial support to the separation discs 21 if these are formed for instance of plastic and have a tendency of expanding radially. It is also simultaneously the elements 65 which are supporting the very conveyor screw 62.

The lower bearing member 64 has a tubular surrounding part carrying a gear ring 66 on its inside. This gear ring 66 is in engagement with a number of gear wheels evenly distributed around the rotor shaft 15 and supported by short taps 67 each of which corresponds to the tap 38 in FIG. 3. The taps 67 thus extend through the rotor end wall 13 and are journalled on its outside by means of bearing members like the bearing members 31 in FIGS. 1 and 3. By rotation of the taps 67 in the same way as has earlier been described with reference to the taps 38 the bearing member 64 and, thereby, the conveyor screw 62 may be rotated relative to the rotor shaft 15.

The centrifugal separator according to the FIGS. 10 and 11 operates for the rest principally in the same manner as the centrifugal separator according to FIG. 1.

What is claimed is:

1. A centrifugal separator for freeing a liquid from solid particles suspended therein and having a density larger than that of the liquid, comprising a rotor (2) having a center axis (4) around which the rotor is rotatable, the rotor comprising two axially spaced end walls (13, 14) and a surrounding wall (17), that is arranged axially between the end walls and surrounds together with the end walls a separation chamber (20), the axial extension of which is substantially larger than the radial extension thereof, the end walls (13, 14) being arranged to be subjected to axially directed forces as a consequence of centrifugally generated pressure of liquid in the separation chamber (20), which forces strive at pushing the end walls (13, 14) away from each other, inlet means (22) forming an inlet (25) for supplying said liquid and particles suspended therein into the separation chamber (20), separation discs (21) which are arranged in the separation chamber (20) for creating small separation distances for particles to be separated from the liquid, first outlet means forming a first outlet (26) for discharge of liquid having been freed from particles, second outlet means forming a second outlet (28) for discharge of particles having been separated from the liquid, a sludge transportation means comprising at least one sludge transportation member (29; 62), which is situated within the separation chamber (20) and is rotatable relative to the rotor (2), when the rotor is rotating, for the transportation of separated particles axially in the separation chamber (20), and a transmission means (9, 10, 30, 42) for rotation of the sludge transportation member (29; 62) relative to the rotor (2), wherein a central member (15) extends between said end walls (13, 14) through the separation chamber (20) and is dimensioned and connected with the two end walls (13, 14) in a way such that it will take up a substantial part of said forces acting axially on the end walls (13, 14) during operation of the rotor, in which the sludge transportation means comprise only one sludge conveyor screw (62) arranged coaxially with the rotor, said transmission means comprising at least one member (67) extending through one of the rotor end walls at a distance from the rotor center axis (4) and engaging the sludge conveyor screw (62) in the separation chamber (20).

2. A centrifugal separator according to claim 1, in which the central member (15) is dimensioned and connected with the two end walls (13, 14) in a way such that it will take up at least half of said forces acting axially on the end walls during operation of the rotor.

3. A centrifugal separator according to claim 1, which the central member (15) is dimensioned and connected with the two end walls (13, 14) in a way such that it will take up at least 80% of said forces acting axially on the end walls during operation of the rotor.

4. A centrifugal separator according to claim 1, in which said second outlet means include means for discharging particles intermittently from the separation chamber (20) through said second outlet (28).

5. A centrifugal separator according to claim 1, in which the rotor (2) is journalled at both of its ends by respective bearings (11, 12).

6. A centrifugal separator according to claim 1, in which the surrounding wall (17) is reinforced by fibers which extend substantially in the circumferential direction of the rotor.

7. A centrifugal separator according to claim 1, in which the rotor (2) is oriented for operation with its center axis (4) extending vertically.

* * * * *